US010553153B2

(12) United States Patent
Liu et al.

(10) Patent No.: US 10,553,153 B2
(45) Date of Patent: Feb. 4, 2020

(54) METHOD, CIRCUIT AND DISPLAY DEVICE FOR DRIVING AN ORGANIC LIGHT EMITTING DIODE

(71) Applicant: BOE TECHNOLOGY GROUP CO., LTD., Beijing (CN)

(72) Inventors: Ying Liu, Beijing (CN); Chenggeng Zhang, Beijing (CN); Zhaohui Meng, Beijing (CN); Hongwei Tian, Beijing (CN); Juanjuan Bai, Beijing (CN); Meng Shao, Beijing (CN); Wen Sun, Beijing (CN); Can Zheng, Beijing (CN); Hualing Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 124 days.

(21) Appl. No.: 15/521,564

(22) PCT Filed: Aug. 30, 2016

(86) PCT No.: PCT/CN2016/097265
§ 371 (c)(1),
(2) Date: Apr. 24, 2017

(87) PCT Pub. No.: WO2017/121124
PCT Pub. Date: Jul. 20, 2017

(65) Prior Publication Data

US 2018/0090064 A1 Mar. 29, 2018

(30) Foreign Application Priority Data

Jan. 11, 2016 (CN) ..... 2016 1 0014133

(51) Int. Cl.
*G09G 3/3233* (2016.01)

(52) U.S. Cl.
CPC ..... *G09G 3/3233* (2013.01); *G09G 2300/043* (2013.01); *G09G 2310/0272* (2013.01);
(Continued)

(58) Field of Classification Search
CPC combination set(s) only.
See application file for complete search history.

(56) References Cited

U.S. PATENT DOCUMENTS 7,656,369 B2 2/2010 Chung et al.
2009/0273591 A1* 11/2009 Jinta ..... G09G 3/3258 345/211

(Continued)

FOREIGN PATENT DOCUMENTS

CN 1776794 A 5/2006
CN 104157240 A 11/2014

(Continued)

OTHER PUBLICATIONS

Written Opinion of the International Searching Authority from PCT Application No. PCT/CN2016/097265, dated Nov. 16, 2016 (5 pages).

*Primary Examiner* — William Boddie
*Assistant Examiner* — Alecia D English
(74) *Attorney, Agent, or Firm* — Dave Law Group LLC; Raj S. Dave

(57) ABSTRACT

A method, a circuit and a display device for driving an organic light emitting diode, wherein a driving transistor (DTFT) for driving a display element is turned off by jumping one or more of a reference voltage input (Vref), a reset voltage input (Vinit) and a data signal input (Vdata) before beginning to output an EL high level (ELVDD) of a pixel compensation circuit and after beginning to output an (Continued)

EL low level (ELVSS), to overcome the splash screen phenomenon during power-up and direct current-direct current driving failure.

22 Claims, 5 Drawing Sheets

(52) U.S. Cl.
CPC ... *G09G 2310/08* (2013.01); *G09G 2330/026* (2013.01); *G09G 2330/028* (2013.01); *G09G 2330/08* (2013.01)

(56) References Cited

U.S. PATENT DOCUMENTS

| | | | |
|---|---|---|---|
| 2009/0309863 | A1 | 12/2009 | Seto |
| 2016/0372049 | A1 | 12/2016 | Wang et al. |
| 2017/0069264 | A1 | 3/2017 | Dai et al. |

FOREIGN PATENT DOCUMENTS

| | | | |
|---|---|---|---|
| CN | 105185304 | A | 12/2015 |
| CN | 105185348 | A | 12/2015 |
| CN | 105405396 | A | 3/2016 |

* cited by examiner

--Prior Art--

--Prior Art--

METHOD, CIRCUIT AND DISPLAY DEVICE FOR DRIVING AN ORGANIC LIGHT EMITTING DIODE

CROSS-REFERENCE TO RELATED APPLICATION

This application claims the benefit and priority of Chinese Patent Application No. 201610014133.3, filed on Jan. 11, 2016. The entire disclosure of the above application is incorporated herein by reference.

FIELD

The present disclosure relates to the display field, and particularly, to a method, a circuit and a display device for driving an organic light emitting diode.

BACKGROUND

Organic Light Emitting Diode (OLED), as a current-type light emitting element, has become a mainstream display element in current display devices because of its light weight, fast response and high contrast. According to the driving modes, i.e., PMOLED (Passive Matrix Driving OLED) and AMOLED (Active Matrix Driving OLED), AMOLED has the advantages of shorter driving time and lower power consumption.

Prior to the normal operation stage of an OLED pixel compensation circuit, the pixel compensation circuit is first powered on and performed the panel short circuit detection by an SSD (Short Circuit Detection) circuit. FIG. 1 shows a conventional OLED pixel compensation circuit in the prior art. The pixel compensation circuit comprises a driving transistor (for example, driving thin-film transistor, DTFT) the source of which is coupled to the EL high level ELVDD of the pixel compensation circuit in a Direct Current-Direct Current (DC-DC) control circuit, the gate of which is coupled to a reset voltage input Vinit, a reference voltage input Vref and a data signal input Vdata, the drain of which is connected to the anode of an OLED display element, the voltage of the cathode of the OLED display element being the EL low level ELVSS of the pixel compensation circuit. The SSD circuit detects the EL low level ELVSS of the pixel compensation circuit. When there is a short circuit on an OLED display device, for example, when a component is damaged or breaked down, a leakage current is generated in the display element, and the leakage current can be detected by the SSD circuit so that the high level ELVDD of the DC-DC output is turned off in time. FIG. 2 shows a typical DC-DC driving timing for the OLED pixel compensation circuit in the prior art. In the power-on process of the pixel compensation circuit, at first the reference voltage input Vref rises to the rated reference voltage, the reset voltage input Vinit drops to the rated reset voltage, then the EL high level ELVDD is input, and the gate-source voltage of the driving thin-film transistor DTFT turns on the DTFT, and the drain outputs the current for driving the display element.

In the conventional driving timing for the pixel compensation circuit of the display device, the EL low level ELVSS is output 10 ms after outputting the EL high level ELVDD, and the SSD circuit begins the detection at the time when outputting the ELVSS, i.e., 10 ms after outputting the ELVDD. However, during this 10 ms period, an abnormal display may occur at the first frame of the outputting of the EL high level ELVDD, which causes a large current, resulting in the generation of the leakage current. The large current lifts the EL low level ELVSS, i.e. the test node voltage of the SSD circuit, resulting in turning on the ESD diode at the EL low level ELVSS end of the DC-DC circuit. For example, the SSD circuit detects an EL low level ELVSS voltage of 700 mV, which is greater than the threshold voltage of 200 mV, then the SSD circuit will erroneously determine the lifting of the EL high level ELVDD as a panel short circuit fault and cut off the output of the DC-DC circuit, and the display device cannot be lit up due to the lack of the EL voltage, i.e., the EL high level ELVDD and the EL low level ELVSS. The above defects of the pixel compensation circuit of the conventional OLED driving circuit will cause the problem that the display panel has a splash screen phenomenon during the power-up and the panel cannot be lit up due to a DC-DC failure.

SUMMARY

One of the objects of the present disclosure is to provide an improved method, circuit and display device for driving an organic light emitting diode capable of overcoming the shortcoming that the DC-DC driving timing in the prior art may cause a splash screen phenomenon during power-up and the display element cannot be lit up due to the DC-DC failure.

According to an aspect of the present disclosure, an embodiment of the present disclosure provides a method for driving an organic light emitting diode in a pixel compensation circuit, the pixel compensation circuit comprising a reference voltage input, a reset voltage input, a data signal input, and a driving transistor for driving a display element, the driving transistor comprising a control electrode for receiving a control signal, a first electrode for receiving an input signal, and a second electrode for outputting an output signal, the reference voltage input, the reset voltage input and the data signal input being coupled to the control electrode of the driving transistor, respectively, an EL high level of the pixel compensation circuit being applied to the first electrode of the driving transistor, the second electrode of the driving transistor being coupled to a first electrode of the display element, and the voltage of a second electrode of the display element being an EL low level of the pixel compensation circuit, wherein the driving transistor is turned off by jumping one or more of the reference voltage input, the reset voltage input, and the data signal input before beginning to output the EL high level and jumping one or more of the jumped reference voltage input, the jumped reset voltage input, and the jumped data signal input again after beginning to output the EL low level.

Wherein, the reference voltage input is jumped from zero to a first reference voltage before beginning to output the EL high level and the reference voltage input is jumped from the first reference voltage to a second reference voltage after beginning to output the EL low level, the first reference voltage being higher than the second reference voltage, the second reference voltage being equal to the rated voltage of the reference voltage input.

Wherein, the reference voltage input is jumped first from zero to the second reference voltage and then is jumped from the second reference voltage to the first reference voltage before beginning to output the EL high level.

Wherein, the reset voltage input is jumped from zero to a first reset voltage before beginning to output the EL high level, and the reset voltage input is jumped from the first reset voltage to a second reset voltage after beginning to output the EL low level, the first reset voltage being higher than the second reset voltage, the second reset voltage being equal to the rated voltage of the reset voltage input.

Wherein, the reset voltage input is kept at zero before beginning to output the EL low level, and is jumped from zero to the second reset voltage after beginning to output the EL low level, the second reset voltage being equal to the rated voltage of the reset voltage input.

Wherein, the data signal input is jumped to a first data signal before beginning to output the EL high level, and the data signal input is jumped from the first data signal to a second data signal after beginning to output the EL low level.

According to another aspect of the present disclosure, an embodiment of the present disclosure provides a circuit for driving an organic light emitting diode, comprising a direct current-direct current control circuit and a pixel compensation circuit, the direct current-direct current control circuit being connected to the pixel compensation circuit, the pixel compensation circuit comprising a reference voltage input, a reset voltage input, a data signal input, and a driving transistor for driving a display element, the driving transistor comprising a control electrode for receiving a control signal, a first electrode for receiving an input signal and a second electrode for outputting an output signal, the reference voltage input, the reset voltage input and the data signal input being coupled to the control electrode of the driving transistor, respectively, an EL high level of the pixel compensation circuit being applied to the first electrode of the driving transistor, the second electrode of the driving transistor being coupled to a first electrode of the display element, the voltage of a second electrode of the display element being an EL low level of the pixel compensation circuit, wherein the direct current-direct current control circuit comprises a voltage jumping unit which is configured to turn off the driving transistor by jumping one or more of the reference voltage input, the reset voltage input and the data signal input before beginning to output the EL high level and to turn on the driving transistor by jumping one or more of the jumped reference voltage input, the jumped reset voltage input and the jumped data signal input again after beginning to output the EL low level.

Wherein, the voltage jumping unit comprises a first boost unit configured to jump the reference voltage input from zero to the first reference voltage before beginning to output the EL high level, and a first buck unit configured to jump the reference voltage input from the first reference voltage to the second reference voltage after beginning to output the EL low level, the first reference voltage being higher than the second reference voltage, the second reference voltage being equal to the rated voltage of the reference voltage input.

Wherein, the first boost unit is configured to jump the reference voltage input from zero to the second reference voltage and then jump from the second reference voltage to the first reference voltage before beginning to output the EL high level.

Wherein, the voltage jumping unit comprises a second boost unit configured to jump the reset voltage input from zero to the first reset voltage before beginning to output the EL high level and a second buck unit configured to jump the reset voltage input from the first reset voltage to the second reset voltage after beginning to output the EL low level, the first reset voltage being higher than the second reset voltage, the second reset voltage being equal to the rated voltage of the reset voltage input.

Wherein, the voltage jumping unit comprises a second buck unit, the reset voltage input is kept at zero before beginning to output the EL low level, the second buck unit is configured to jump the reset voltage input from zero to the second reset voltage after beginning to output the EL low level, and the second reset voltage is equal to the rated voltage of the reset voltage input.

Wherein, the voltage jumping unit comprises a third boost unit configured to jump the data signal input from zero to the first data signal before beginning to output the EL high level and a third buck unit configured to jump the data signal input from the first data signal to the second data signal after beginning to output the EL low level.

Wherein, the voltage jumping unit is preferably integrated into an IC.

According to a further aspect of the present disclosure, an embodiment of the present disclosure provides a display device comprising the circuit for driving an organic light emitting diode as described above.

Compared with the prior art, the method, the circuit and the display device for driving an organic light emitting diode provided by the present disclosure control the voltage of the control electrode of the driving transistor DTFT by jumping one or more of the reference voltage input, the reset voltage input and the data signal input before beginning to output the EL high level so as to turn off the driving transistor DTFT, control the voltage of the control electrode of the driving transistor DTFT by jumping one or more of the reference voltage input, the reset voltage input and the data signal again after beginning to output the EL low level so as to turn on the driving transistor DTFT, and prevent the leakage current caused by the abnormal rising of the EL high level ELVDD of the SSD circuit when the SSD circuit detects a panel short circuit fault, so that the SSD circuit can normally complete the detection and prevent the leakage current from driving the display element to generate a splash screen phenomenon. Therefore, it is possible to realize the normal driving for the display device during the power-up process of the pixel compensation circuit, improving the display effect of the OLED display device, and to improve the detection efficiency of the SSD circuit, avoiding the splash screen phenomenon and the phenomenon that the display element cannot be lit due to a DC-DC failure.

DRAWINGS

To make the purpose, technical solutions, and advantages of the present disclosure apparent, embodiments of the present disclosure will further be described below in details in combination with the drawings. In the drawings, the same reference signs indicate the same elements. Those skilled in the art will understand that the specific embodiments depicted in the drawings are intended for purposes of illustration only and are not intended to limit the technical solutions of the present disclosure. In the drawings.

DETAILED DESCRIPTION

Figure 1:
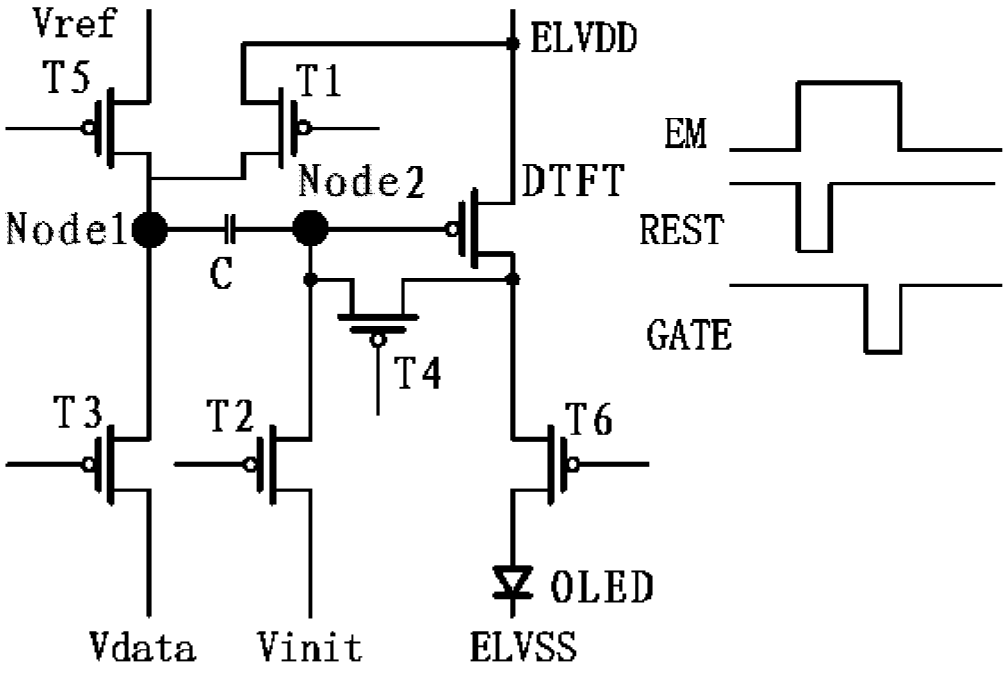
FIG. 1 shows a schematic diagram of a pixel compensation circuit in the prior art.

The technical solutions in the embodiments of the present disclosure will be described clearly and completely below in conjunction with the accompanying drawings of the present disclosure. It is to be understood that the specific embodiments of the present disclosure are illustrative only and are not to be construed as limiting the scope of protection of the present disclosure.

Those skilled in the art will appreciate that the terms used herein are only for the purpose of describing particular embodiments and are not intended to limit the disclosure. As used herein, the singular forms "a", "an" and "the" are intended to comprise the plural forms as well, unless expressly stated in other cases. It should be further understood that when the terms "comprise", "include", "comprising" and/or "including" are used in this specification, they refer to the elements and/or components that exist but do not exclude the presence or addition of one or more other elements, components and/or combinations thereof.

Unless otherwise defined, all terms (comprising technical and scientific terms) used herein have the same meaning commonly understood by those skilled in the art to which the disclosed subject matter belongs. It will be further understood that terms, such as those defined in commonly used dictionaries, should be interpreted as the meanings consistent with their meanings in the context of the description and the related art, and will not be explained in an idealized or overly formal form, unless otherwise explicitly defined herein. "First", "second", "third", "fourth" and similar terms used in this disclosure do not denote any order, quantity, or importance, but are used to distinguish different components only. As used herein, the statement "connecting" or "coupling" two or more components together shall mean that the parts are directly combined together or combined together through one or more intermediate components.

In all embodiments of the present disclosure, the switching elements employed are illustrated by example of P-type field effect (MOS) transistors, and also may employ N-type field effect transistors, and P-type or N-type bipolar (BJT) transistors to implement the functions of the switching elements. Since source and drain of a transistor (emitter and collector) are symmetrical, and a P-type transistor and a N-type transistor have opposite directions in turn-on current between source and drain (emitter and collector), in the embodiments of the present disclosure, it is specified that a controlled intermediate terminal of a transistor is the gate, a signal input terminal is the source, and a signal output terminal is the drain. Further, any controlled switching device with gating signal input may be employed to implement the functions of the switching elements, the controlled intermediate terminal of the switching device for receiving a control signal (for example, for turning on and off the controlled switching device) being called a control electrode, the signal input terminal being called the first electrode, and the signal output terminal being called the second electrode. The transistors employed in the embodiments of the present disclosure are primarily switching transistors. The driving method, the driving circuit and the display device for organic light emitting diode of the present disclosure are mainly used for OLED display elements, particularly AMOLED display elements.

FIG. 1 shows a pixel compensation circuit in the prior art. The pixel compensation circuit comprises a driving thin-film transistor DTFT and first to sixth switching elements T1 to T6, and a reference voltage input Vref, a reset voltage input Vinit, a data signal input Vdata, an EL high level ELVDD and an EL low level ELVSS for driving the pixel compensation circuit of the display element.

Wherein:

The gate of the first switching element T1 is coupled to the REST signal input, the source thereof is coupled to the EL high level ELVDD from the DC-DC input for driving the display element and the drain thereof is coupled to a node 1;

The gate of the second switching element T2 is likewise coupled to the REST signal input, the source thereof is coupled to the reset voltage input Vinit, and the drain thereof is coupled to the gate of the driving thin-film transistor DTFT via a node 2;

The gate of the third switching element T3 is coupled to the GATE signal input, the source thereof is coupled to the data signal input Vdata, and the drain thereof is coupled to the node 1;

The gate of the fourth switching element T4 is coupled to the GATE signal input, the source thereof is coupled to the drain of the driving thin-film transistor DTFT and the drain thereof is coupled to the node 2;

The gate of the fifth switching element T5 is coupled to the EM signal input, the source thereof is coupled to the reference voltage input Vref, and the drain thereof is coupled to the drain of the first switching element T1 and the drain of the third switching element T3 via the node 1, respectively;

The gate of the sixth switching element T6 is coupled to the EM signal input, the source thereof is coupled to the drain of the driving thin-film transistor DTFT and to the source of the fourth switching element T4, and the drain thereof is coupled to the positive electrode of the OLED or AMOLED display element;

The gate of the driving thin-film transistor DTFT is coupled to the drain of the fourth switching element T4, the drain of the second switching element T2 and the storage capacitor C via the node 2, respectively, and the source thereof is similarly coupled to the EL high level ELVDD, and the drain thereof is coupled to the source of the sixth switching element T6;

The positive electrode of the display element is coupled to the drain of the sixth switching element and the negative electrode thereof is the EL low level ELVSS of the pixel compensation circuit; and The storage capacitor C is coupled between the node 1 and the node 2.

It can be seen that the gate of the driving thin-film transistor DTFT is coupled to the reference voltage input Vref through the storage capacitor C and the fifth switching element T5, to the data signal input Vdata through the storage capacitor C and the third switching element T3, and to the reset voltage input Vinit through the second switching element T2, respectively.

The operation process in which the pixel compensation circuit drives the display element will be described below according to FIGS. 1 and 2. The operation process mainly has three stages: reset stage, data writing stage and light emitting stage.

The reset (Rest) stage is used to reset the gate voltage of the driving thin-film transistor to prepare for displaying the next frame of image on a display panel. The Rest signal is first set at a low level, at which time the first and second switching elements T1, T2 are turned on. The rated reset voltage input Vinit2 is input to the gate of the driving thin-film transistor DTFT via the node 2 to set the gate voltage Vgate of the DTFT to a low level to ensure that the Vdata voltage can be normally written and the voltage of the node 1 is written to the EL high level ELVDD.

The data writing (Gate) phase is used to write a control sequence to display a pattern on the panel. First, the gate of the DTFT is set at a low level, at which time the third and fourth switching elements T3, T4 are turned on. A data signal is then input to the Vdata input node 1 to write the control sequence. The voltage at the node 2 is ELVDD−$|V_{th}|$, where $V_{th}$ is the threshold voltage of the switching element. When the ELVDD is zero, the voltage at the node 2 is $-|V_{th}|$.

The light emitting (EM) stage is used to drive the display element to emit light according to the control sequence. The EM signal is first set to a low level, at which time the fifth and sixth switching elements T5, T6 are turned on. Then, the rated reference voltage input Vref2 is applied to the node 1. Since the voltage across the capacitor C cannot be transient, the voltage at the node 2 becomes ELVDD−$|V_{th}|$+Vref2−Vdata.

According to the above analysis, the voltages at nodes 1 and 2 in different stage periods are shown in Table 1.

TABLE 1

Voltages at Nodes 1 and 2 under the Conventional Driving Timing

| Period | Voltage at node 1 | Voltage at node 2 |
|---|---|---|
| Rest Start | ELVDD | Vinit2 |
| Gate Start | Vdata | $-\|V_{th}\|$ |
| Em Start | Vref2 | $-\|V_{th}\|$ + Vref2 − Vdata |

Figure 2:
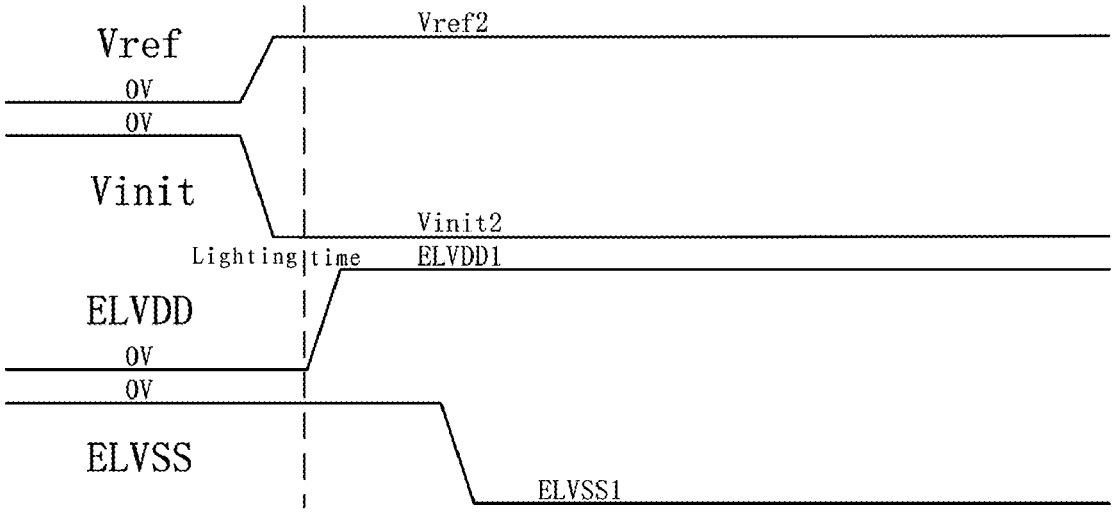
FIG. 2 shows a DC-DC driving timing diagram of the pixel compensation circuit in the prior art.

The operation states of the pixel compensation circuit under normal and abnormal conditions are now analyzed in detail according to the conduction characteristics of the transistor and the DC-DC driving timing diagram in the prior art shown in FIG. 2

$$\text{Switching element current formula: } I = \frac{1}{2}\mu C_{OX}\frac{W}{L}(V_{GS} - V_{th})^2$$

Where μ is the electron mobility ratio, $C_{OX}$ is the oxide layer capacitance per unit area, W is the thickness of the channel depletion layer, L is the channel length, $V_{GS}$ is the gate-source voltage of the switching element, and $V_{th}$ is the threshold voltage of transistor.

Under normal circumstances, for the driving thin-film transistor DTFT:

$$V_{GS} - V_{th} = ELVDD - |V_{th}| + Vref - Vdata - ELVDD - V_{th} = Vref - Vdata > 0$$

$$I = \frac{1}{2}\mu C_{OX}\frac{W}{L}(Vref - Vdata)^2$$

Since $V_{GS}>V_{th}$, the driving thin-film transistor DTFT is turned off, the large current inputted by the EL high level ELVDD does not flow to the display element, and the panel will light normally.

However, under abnormal circumstances, when the EL high level ELVDD is suddenly outputted, and rises from the original ELVDD1 to the ELVDD2, for example, from 0V to 4.6V, for the driving thin-film transistor DTFT:

$$V_{GS} - V_{th} = ELVDD1 - |V_{th}| + Vref - Vdata - ELVDD2 - V_{th} = ELVDD1 + Vref - Vdata - ELVDD2 < 0$$

$$I = \frac{1}{2}\mu C_{OX}\frac{W}{L}(ELVDD1 - V_{th} + Vref - Vdata - ELVDD2 - V_{th})^2 = \frac{1}{2}\mu C_{OX}\frac{W}{L}(ELVDD1 + Vref - Vdata - ELVDD2)^2$$

Where ELVDD is no longer constant and therefore cannot be offset by an operation. The difference between ELVDD2 and ELVDD1 will cause the current I to become larger. Since $V_{GS}<V_{th}$, the driving thin-film transistor DTFT is turned on, resulting in a large current between the EL high level ELVDD and the EL low level ELVSS. The large current will cause two problems: 1) that the first frame of picture of the display panel is displayed abnormally and a splash screen phenomenon occurs; 2) that the voltage at the EL low level ELVSS is excessively high, so that the SSD circuit in the DC-DC driving circuit detects the voltage of the EL low level ELVSS higher than the threshold voltage in the panel short circuit detection after beginning to output the EL high level ELVDD for 10 ms, whereby this state is erroneously recognized as a panel short circuit and then the DC-DC input is erroneously turned off so that it cannot be initiated and fail, causing the display element to fail to obtain the EL voltage, i.e., the EL high level ELVDD and the EL low level ELVSS, provided by DC-DC circuit for lighting the panel.

Therefore, in order to avoid the phenomenon of the splash screen caused by the abnormal rising of the EL high level ELVDD and the phenomenon that the display element cannot be lit due to the DC-DC failure, the key is that the large current cannot pass through the DTFT when the EL high level ELVDD abnormally rises, so as not to affect the voltage of the EL low level ELVSS, i.e., not affecting the driving voltage of the display element and the detection voltage of the SSD circuit.

The turn-on and turn-off of the driving tine-film transistor DTFT depends on the gate-source voltage $V_{GS}$ of the DTFT. The $V_{GS}$ can be controlled by changing the gate voltage of the DTFT when the source voltage (i.e., the EL high level EVLDD) is uncontrollable. As can be seen from the pixel compensation circuit shown in FIG. 1, the gate voltage of the driving thin-film transistor DTFT can be controlled by one or more of the reference voltage input Vref, the reset voltage input Vinit, and the data signal input Vdata. Thus, one or more of Vref, Vinit and Vdata may be jumped before the EL high level ELVDD begins to raise the gate voltage of the driving thin-film transistor DTFT so as to be able to supply sufficient gate-source voltage $V_{GS}$ to turn off the DTFT even if the ELVDD abnormally rises, and then one or more of the jumped Vref, Vinit and Vdata is jumped again after beginning to output the EL low level so as to resume the normal display of the display element.

Figure 3:
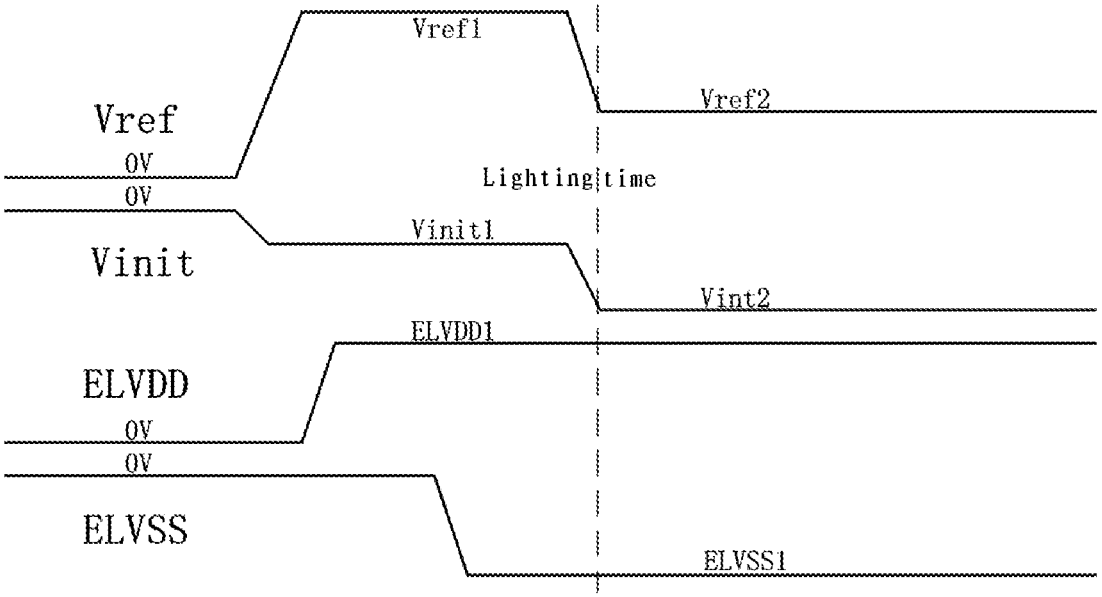
FIG. 3 shows a DC-DC driving timing diagram of the improved pixel compensation circuit according to an embodiment of the present disclosure.

For the above analysis, FIG. 3 shows a DC-DC driving timing after the DC-DC driving timing of the conventional pixel compensation circuit is improved. Wherein the reference voltage input Vref rises from zero to the reference voltage Vref1 higher than the rated reference voltage Vref2 before beginning to output the EL high level ELVDD, and the reference voltage input Vref decreases from Vref1 to the rated reference voltage Vref2 after beginning to output the EL low level ELVSS. At the same time, the reset voltage input Vinit decreases from zero to the reset voltage Vinit1 higher than the rated reset voltage Vinit2 before beginning to output the EL high level ELVDD, and the reset voltage input Vinit decreases from Vinit1 to the rated reset voltage Vinit2 after beginning to output the EL low level ELVSS.

The reference voltage Vref1 and the reset voltage Vinit are selected so that the gate voltage of the driving thin-film transistor DTFT is always controlled during the period before beginning to output the EL high level ELVDD and after beginning to output the EL low level ELVSS, that is, the time period of the detection of the SSD circuit, to turn off the DTFT. For example, when the EL high level ELVDD suddenly jumps, the reference voltage Vref1 and the reset voltage Vinit1 allow the gate-source voltage $V_{GS}$ of the driving thin-film transistor DTFT to be larger than its threshold voltage $V_{th}$, i.e., Vinit1+Vref1−ELVDD1>$V_{th}$, to ensure that the driving thin-film transistor DTFT is turned off. The jumping of the reference voltage input Vref and reset voltage input Vinit continues during this period to sufficiently ensure that the display element is normally displayed during power-up, that there is no large current resulting in the splash screen phenomenon of the display panel, and that the panel short circuit detection of the SSD circuit will not be affected.

Thus, the state of the display element driven by the pixel compensation circuit employing the improved DC-DC driving timing changes in operation stage as follows:

In the reset stage, the Rest signal is set at a low level and the first and second switching elements T1, T2 are turned on. The EL high level ELVDD is then applied to the node 1, and the reset voltage Vinit1 is applied to the node 2;

In the data writing stage, the gate Gate signal of the driving thin-film transistor DTFT is set to a low level, and the third and fourth switching elements T3, T4 are turned on. Then the data signal input Vdata is applied to the node 1. Since the voltage across the capacitor C cannot be changed instantaneously, the voltage at the node 2 is Vdata+Vinit1−ELVDD. When the ELVDD is zero, the voltage at the node 2 is Vdata+Vinit1;

In the light emitting stage, the EM signal is set to a low level, and the fifth and sixth switching elements T5, T6 are turned on. Then, the reference voltage Vref1 is applied to the node 1. Since the voltage across the capacitor C cannot be changed instantaneously, the voltage at the node 2 is Vdata+Vinit1+Vref1-Vdata, and the voltage at the node 2 after Vdata is offset is Vint1+Vref1.

After the display panel is normally lit, $V_{GS}$=Vinit1+Vref1−ELVDD1>$V_{th}$, then the driving thin-film transistor DTFT is turned off and operates normally.

The node voltages of the node 1 and node 2 in the display of the first frame of image a according to the pixel compensation circuit employing the above-mentioned improved DC-DC driving timing are shown in Table 2.

TABLE 2

Node Voltages of Nodes 1 and 2 under the Improved Driving Timing

| Period | Node 1 | Node 2 |
|---|---|---|
| Rest Start | ELVDD | Vinit1 |
| Gate Start | Vdata | Vdata + Vinit1 |
| Em Start | Vref1 | Vinit1 + Vref1 |

The voltage jumping of the reference voltage input Vref and reset voltage input Vinit in the above-mentioned improved DC-DC driving timing can be implemented by a voltage jumping unit.

Figure 4:
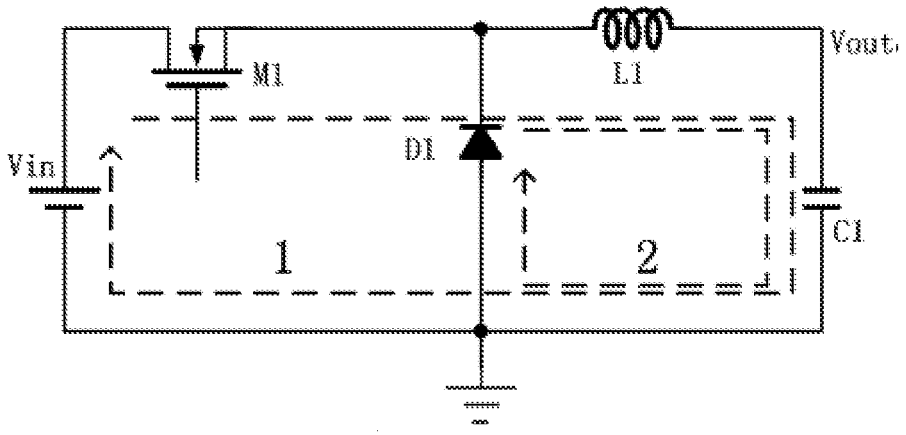
FIG. 4 shows a circuit diagram of the buck unit employed according to an embodiment of the present disclosure.
Figure 5:
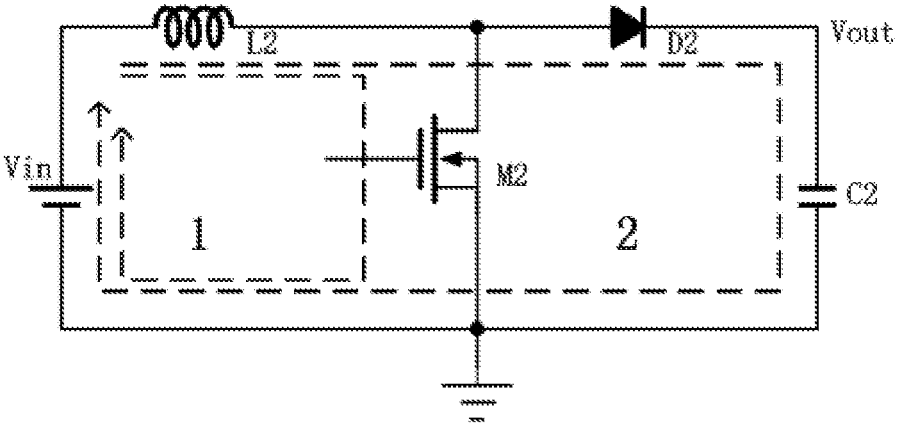
FIG. 5 shows a circuit diagram of the boost unit employed according to an embodiment of the present disclosure.

The voltage jumping unit may be implemented by a buck unit as shown in FIG. 4 and a boost unit as shown in FIG. 5. The reference voltage input Vref, the reset voltage input Vinit and the data signal input Vdata are used as the input voltage Vin of the buck unit or the boost unit, respectively, and the output voltage Vout output by the buck unit or the boost unit through pulse (PLUSE) control is used as the jumped reference voltage input Vref, the jumped reset voltage input Vinit and jumped the data signal input Vdata. Wherein, the switching element employs MOS transistor, and also may employ a bipolar transistor or other switching components with gated signal input.

The buck unit shown in FIG. 4 comprises a MOS transistor M1, an inductor L1, a diode D1, a capacitor C1, and an input voltage Vin and an output voltage Vout. The MOS transistor M1 is driven by a PWM (Pulse Width Modulation) signal, where the signal period is $T_S$ and the on-time is $T_{ON}$, then the duty cycle D=$T_{ON}/T_S$<1.

When the MOS transistor M1 is turned on, the diode D1 is turned off, the current direction is shown as the dotted line 1, and the voltage across the inductor is $V_{L,ON}$=Vin−Vout=L($dI_{L,ON}$/dt) (assuming $V_M$=0).

When the MOS transistor M1 is turned off, the inductor L1 continues to flow, the diode D1 is turned on as shown by the dotted line 2, and the voltage across the inductor is $V_{L,OFF}$=−Vout=L($dI_{L,OFF}$/dt) (assuming $V_D$=0).

When the buck unit is in a stable state, the total amount of change of current in one switching cycle of the MOS transistor is zero, that is, the amount of increase of current passing through the inductor when the MOS transistor is turned on is equal to the amount of decrease of current of the inductor when the MOS transistor is turned off, whereby the voltage of the inductor in one switching cycle is:

$$V_L(t)=V_{L,ON}(t)+V_{L,OFF}(t)=(V\text{in}-V\text{out})*DT_S+(-V\text{out})*(1-D)T_S=0$$

Thus, $V\text{out}=D*V_{IN}$.

Where $V_L$ is the inductor voltage, $V_M$ is the source-drain voltage of the MOS transistor M1, and $V_D$ is the diode voltage.

The boost unit shown in FIG. 5 comprises a MOS transistor M2, an inductor L2, a diode D2, a capacitor C2, and an input voltage Vin and an output voltage Vout. The MOS transistor 2 is driven by a PWM (Pulse Width Modulation) signal, wherein the signal period is $T_S$, the on-time is $T_{ON}$, and the duty ratio D=$T_{ON}/T_S$<1.

When the MOS transistor M2 is turned on, the diode D2 is turned off as shown by the dotted line 1, and the voltage across the inductor is $V_{L,ON}$=Vin (assuming $V_M$=0)

When the MOS transistor M2 is turned off, the inductor L2 continues to flow, the diode is turned on as shown by the dotted line 2, and the voltage across the inductor is $V_{L,OFF}$=Vin−Vout (assuming $V_D$=0).

Similar to the derivation of the buck unit in FIG. 4, the voltage of the inductor in one switching cycle is:

$$V_L(t)=V_{L,ON}(t)+V_{L,OFF}(t)=V\text{in}*DT_S+(V\text{in}-V\text{out})*(1-D)T_S=0$$

Thus, $V\text{out}=(1-D)^{-1}*V\text{in}$

The above buck and boost units can also be integrated into an IC integrated circuit with a register as a voltage jumping unit. By modifying the register settings to output the improved driving timing, the IC can be used to complete the DC-DC driving of the display panel. The IC is, but is not limited to, TPS 65633 or DW 8722.

The foregoing describes the improved DC-DC driving method, control circuit and display device by jumping a reference voltage input Vref and a reset voltage input Vinit at the same time. In addition, it is also possible to use one of the reference voltage input Vref, the reset voltage input Vinit and the data signal input Vdata or combine more than one of the three to maintain the turn-off of the driving thin-film transistor DTFT in the period before the EL high level ELVDD starts to be outputted and after the EL low level ELVSS starts to be outputted.

Figure 6:
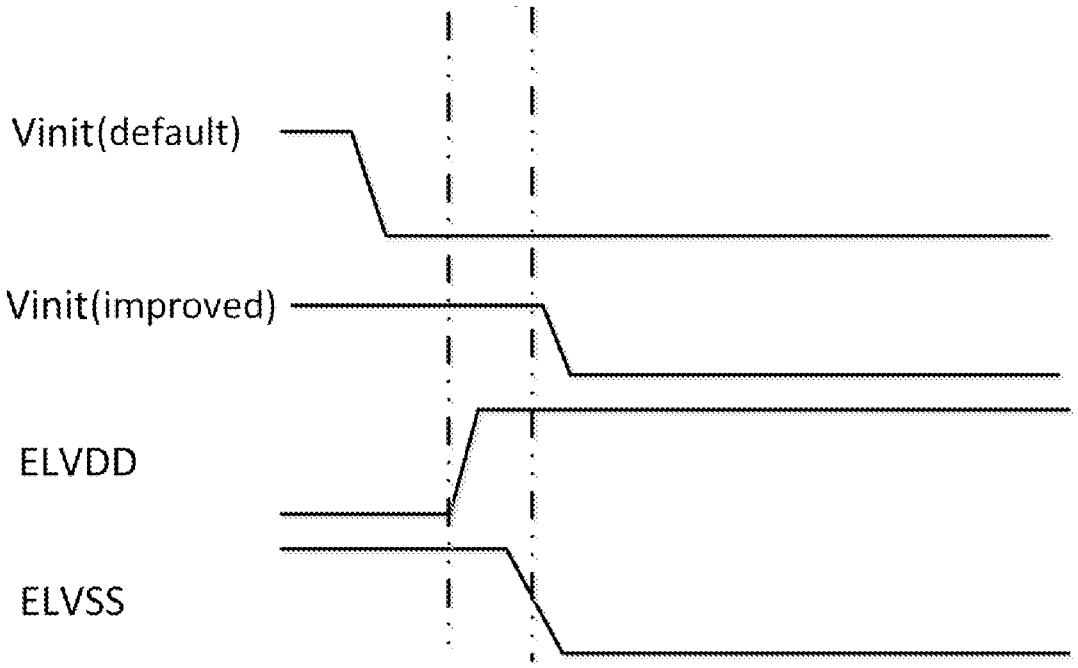
FIG. 6 shows a DC-DC driving timing diagram of another improved pixel compensation circuit according to an embodiment of the present disclosure.

For example, the driving timing shown in FIG. 6 describes an embodiment of jumping the reset voltage input Vinit of the present disclosure only. In a case where the reference voltage input Vref and the data signal input Vdata are not modified, the reset voltage input Vref remains zero before beginning to output the EL low level ELVSS, and decreases from zero to the rated reset voltage after beginning to output the EL low level ELVSS.

Figure 7:
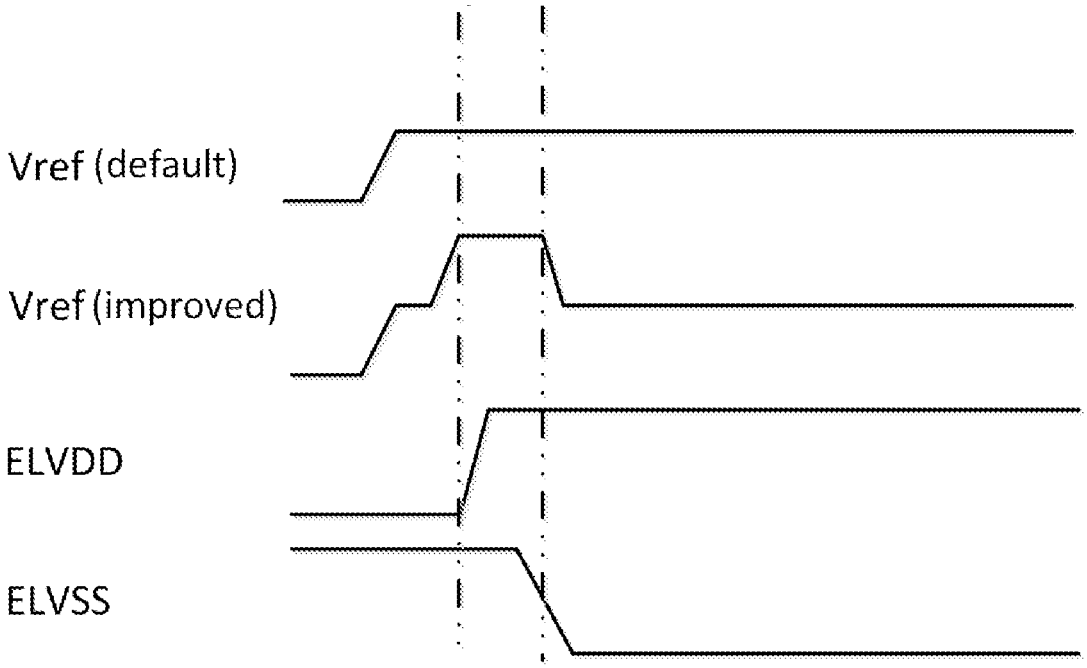
FIG. 7 shows a DC-DC driving timing diagram of another improved pixel compensation circuit according to an embodiment of the present disclosure.

Further, it is also possible to improve the way in which the voltage jumps. FIG. 7 shows a DC-DC driving timing of the reference voltage input Vref with multiple jumpinings. In a case where the reset voltage input Vinit is not modified, the reference voltage input Vref first rises to the rated reference voltage before beginning to output the EL high level ELVDD, then rises to the reference voltage higher than the rated reference voltage, for example, in a stepped manner, and thereafter beginning to output the EL high level ELVDD. After beginning to output the ELVSS, the reference voltage input Vref decreases to the rated reference voltage.

The above further improvement is also applicable to the other inputs of the reference voltage input Vref, the reset voltage input Vinit and the data signal input Vdata.

It will be appreciated by those skilled in the art that the problem of the splash screen phenomenon in power-up and DC-DC failure can also be solved and overcome by adopting other voltage jumping manners that are not shown in the example embodiment but can be easily conceived.

The method, the circuit and the display device provided by the present disclosure using voltage jumping to turn off the driving thin-film transistor DTFT before beginning to output the EL high level and another voltage jumping to turn on the driving thin-film transistor DTFT for an organic light emitting diode after beginning to output the EL low level, can improve the display effect of the OLED or AMOLED display device, enhance the detection efficiency of the SSD circuit, avoid the splash screen phenomenon in power-up and the phenomenon that the display element cannot be lit due to the DC-DC failure, thereby effectively reducing the power and life loss of the display device and the driving circuit.

The description of the present disclosure has provided for purpose of illustration and description. It is not intended to be exhaustive or to limit the present disclosure. Many modifications and variations will be apparent to those of ordinary skill in the art. Any technical solution that uses signal/voltage jumping to turn off the DTFT during power-up to overcome the splash screen phenomenon and DC-DC driving failure falls within the scope of protection of this disclosure. The selection and description of the embodiments are intended to best explain the principles and practical applications of the present disclosure and, when appropriate for the particular use contemplated, make it possible for others of ordinary skill in the art to understand the embodiments with various modifications of the present disclosure. Accordingly, the particular arrangements disclosed are intended to the purpose of illustration only and not limitation to the scope of the disclosed concept, which is based on the full scope of the appended claims and any and all equivalents thereof.

The invention claimed is:

1. A method for driving a display element with a pixel compensation circuit, the pixel compensation circuit comprising a reference voltage input, a reset voltage input, a data signal input, and a driving transistor for driving a display element, the reference voltage input, the reset voltage input and the data signal input coupled to a control electrode of the driving transistor, a first electrode of the driving transistor configured to receive an EL high level voltage, and the display element including a first electrode coupled to a second electrode of the driving transistor and a second electrode configured to receive an EL low level voltage, the method comprising:

changing the reference voltage input from zero to a first reference voltage before beginning to output the EL high level voltage to turn off the driving transistor, providing the EL high level voltage to the first electrode of the driving transistor;

providing the EL low level voltage to the second electrode of the display element; and changing the reference voltage input from the first reference voltage to a second reference voltage after beginning to output the EL low level voltage to turn on the driving transistor, wherein the first reference voltage is higher than the second reference voltage, and wherein the second reference voltage is equal to a rated voltage of the reference voltage input.

2. The method according to claim 1, wherein changing the reference voltage input from zero to the first reference voltage to turn off the driving transistor includes changing the reference voltage input first from zero to the second reference voltage and then from the second reference voltage to the first reference voltage.

3. The method according to claim 2, further comprising changing the reset voltage input from zero to a first reset voltage before providing the EL high level voltage, and changing the reset voltage input from the first reset voltage to a second reset voltage after providing the EL low level voltage, wherein the first reset voltage is higher than the second reset voltage, and wherein the second reset voltage is equal to the rated voltage of the reset voltage input.

4. The method according to claim 3, further comprising changing the data signal input to a first data signal before providing the EL high level voltage, and changing the data signal input from the first data signal to a second data signal after providing the EL low level voltage.

5. The method according to claim 2, further comprising changing the data signal input to a first data signal before providing the EL high level voltage, and changing the data signal input from the first data signal to a second data signal after providing the EL low level voltage.

6. The method according to claim 2, further comprising maintaining the reset voltage input at zero before providing the EL low level voltage, and changing the reset voltage input from zero to a second reset voltage after providing the EL low level voltage, wherein the second reset voltage is equal to the rated voltage of the reset voltage input.

7. The method according to claim 6, further comprising the data signal input to a first data signal before providing the EL high level voltage, and changing the data signal input from the first data signal to a second data signal after providing the EL low level voltage.

8. The method according to claim 1, further comprising changing the reset voltage input from zero to a first reset voltage before providing the EL high level voltage, and changing the reset voltage input from the first reset voltage to a second reset voltage after providing the EL low level voltage, wherein the first reset voltage is higher than the second reset voltage, and wherein the second reset voltage is equal to the rated voltage of the reset voltage input.

9. The method according to claim 1, further comprising maintaining the reset voltage input at zero before providing the EL low level voltage, and changing the reset voltage input from zero to a second reset voltage after providing the EL low level voltage, wherein the second reset voltage is equal to the rated voltage of the reset voltage input.

10. The method according to claim 1, further comprising changing the data signal input to a first data signal before providing the EL high level voltage, and changing the data signal input from the first data signal to a second data signal after providing the EL low level voltage.

11. A circuit for driving a display element, the circuit comprising:

a direct current-direct current control circuit; and a pixel compensation circuit, the direct current-direct current control circuit connected to the pixel compensation circuit, the pixel compensation circuit comprising a reference voltage input, a reset voltage input, a data signal input, and a driving transistor for driving a display element, the reference voltage input, the reset voltage input and the data signal input coupled to a control electrode of the driving transistor, a first electrode of the driving transistor configured to receive an EL high level voltage, the display element including a first electrode configured to couple to a second electrode of the driving transistor and a second electrode configured to receive an EL low level voltage, wherein the direct current-direct current control circuit comprises a voltage changing unit configured to change the reference voltage input from zero to a first reference voltage before beginning to output the EL high level voltage to turn off the driving transistor; and change the reference voltage input from the first reference voltage to a second reference voltage after beginning to output the EL low level voltage to turn on the driving transistor, wherein the EL high level voltage is provided to the second electrode of the driving transistor after the reference voltage input is changed to the first reference voltage;

wherein the EL low level voltage is provided to the second electrode of the display element before the reference voltage input is changed from the first reference voltage to the second reference voltage, and wherein the first reference voltage is higher than the second reference voltage, and the second reference voltage is equal to a rated voltage of the reference voltage input.

12. The circuit according to claim 11, wherein the voltage changing unit is further configured to change the reference voltage input from zero to the second reference voltage and then change from the second reference voltage to the first reference voltage.

13. The circuit according to claim 12, wherein the voltage changing unit is further configured to change the reset voltage input from zero to a first reset voltage before the EL high level voltage is provided to the first electrode of the driving transistor, and change the reset voltage input from the first reset voltage to a second reset voltage after the EL low level voltage is provided to the second electrode of the display element, wherein the first reset voltage is higher than the second reset voltage, and wherein the second reset voltage being equal to the rated voltage of the reset voltage input.

14. The circuit according to claim 13, wherein the voltage changing unit is further configured to change the data signal input from zero to a first data signal before the EL high level voltage is provided to the first electrode of the driving transistor, and change the data signal input from the first data signal to a second data signal after the EL low level voltage is provided to the second electrode of the display element.

15. The circuit according to claim 12, wherein the voltage changing unit is further configured to change the data signal input from zero to a first data signal before the EL high level voltage is provided to the first electrode of the driving transistor, and change the data signal input from the first data signal to a second data signal after the EL low level voltage is provided to the second electrode of the display element.

16. The circuit according to claim 12, wherein the voltage changing unit is further configured to maintain the reset voltage input at zero before the EL low level voltage is provided to the second electrode of the display element, and change the reset voltage input from zero to a second reset voltage after the EL low level voltage is provided to the second electrode of the display element, and wherein the second reset voltage is equal to the rated voltage of the reset voltage input.

17. The circuit according to claim 16, wherein the voltage changing unit is further configured to change the data signal input from zero to a first data signal before the EL high level voltage is provided to the first electrode of the driving transistor, and chancre the data signal input from the first data signal to a second data signal after the EL low level voltage is provided to the second electrode of the display element.

18. The circuit according to claim 11, wherein the voltage changing unit is further configured to change the reset voltage input from zero to a first reset voltage before the EL high level voltage is provided to the first electrode of the driving transistor, and change the reset voltage input from the first reset voltage to a second reset voltage after the EL low level voltage is provided to the second electrode of the display element, wherein the first reset voltage is higher than the second reset voltage, and wherein the second reset voltage is equal to the rated voltage of the reset voltage input.

19. The circuit according to claim 11, wherein the voltage changing unit is further configured to maintain the reset voltage input at zero before the EL low level voltage is provided to the second electrode of the display element, and change the reset voltage input from zero to a second reset voltage after the EL low level voltage is provided to the second electrode of the display element, and wherein the second reset voltage is equal to the rated voltage of the reset voltage input.

20. The circuit according to claim 11, wherein the voltage changing unit is further configured to change the data signal input from zero to a first data signal before the EL high level voltage is provided to the first electrode of the driving transistor, and change the data signal input from the first data signal to a second data signal after the EL low level voltage is provided to the second electrode of the display element.

21. The circuit according to claim 11, wherein the voltage changing unit is integrated into an IC.

22. An OLED display device comprising the circuit for driving an organic light emitting diode according to claim 11.

* * * * *